United States Patent [19]

Roth

[11] 4,395,607

[45] Jul. 26, 1983

[54] GAS BLAST SWITCH

[75] Inventor: Adrian W. Roth, Aarau, Switzerland

[73] Assignee: Sprecher & Schuh AG, Aarau, Switzerland

[21] Appl. No.: 298,045

[22] Filed: Aug. 31, 1981

[30] Foreign Application Priority Data

Sep. 1, 1980 [CH] Switzerland ..... 6564/80

[51] Int. Cl.[3] ..... H01H 33/72

[52] U.S. Cl. ..... 200/148 R

[58] Field of Search ..... 200/148 R, 148 A

[56] References Cited

FOREIGN PATENT DOCUMENTS 2373141 6/1978 France ..... 200/148 A

*Primary Examiner*—Robert S. Macon

*Attorney, Agent, or Firm*—Ladas & Parry

[57] ABSTRACT

The gas blast switch of the invention has an insulating housing which is divided into an arcing enclosure for an auxiliary arc intended to build up the pressure, a storage enclosure for storing fresh quenching gas, a quenching enclosure meant for the quenching of the main arc, and an expansion enclosure. An axially movable insulating follower piston is provided within the fixed contact piece. During switching-on, it is pushed into its resting position through the action of the movable contact piece and against the force of a spring. During switching-off, it will follow the movable contact piece until the latter leaves the dividing wall, whereupon the piston stops, thus closing the aperture in the dividing wall which connects arcing and quenching enclosures. An electrically conductive ring forms the mouth of the aperture and acts as an arcing electrode between the auxiliary arc and the main arc. During a switch-off with quenching action, the pressure built up by the auxiliary arc drives fresh gas from the storage enclosure into the quenching enclosure.

5 Claims, 1 Drawing Figure

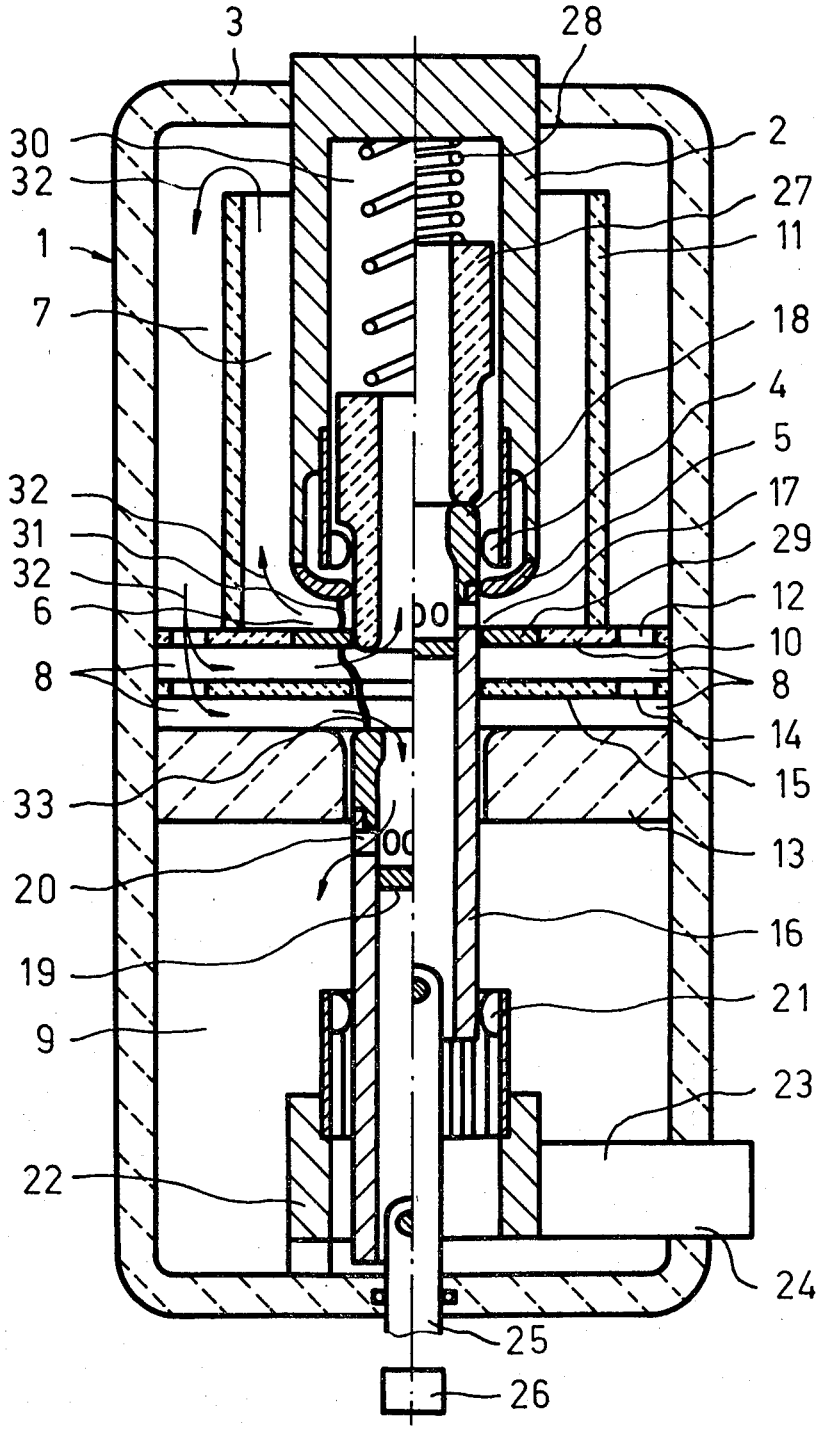
3
28
30
2
32
27
1
11
7
18
4
5
32
17
31
29
32
12
6
10
8
8
14
15
33
13
20
16
19
21
9
23
22
24
25
26

GAS BLAST SWITCH

FIELD OF THE INVENTION

The invention concerns a gas blast switch with a resting contact piece and a rodlike movable contact piece which can be axially engaged with the resting contact piece, and with a housing, the interior of which is divided into an arcing enclosure which extends between a consumable electrode situated in front of the resting contact piece and a separation wall fitted into the housing, remote from said consumable electrode in the switching-off direction and having an aperture for the passage of the movable contact piece, a quenching enclosure which extends between said separation wall and an intermediate partition fitted into the housing on the far side of said separation wall, again as seen in the switching-off direction, and an expansion enclosure which lies on the side of the partition opposite to the quenching enclosure to which it becomes connected by a gas-path through a channel which is freed from the movable contact piece during the switching movement, where the arching enclosure and the quenching enclosure are connected by way of a storage enclosure which has a larger capacity than the arcing enclosure and exhibits at least one flow-diverter.

DESCRIPTION OF THE PRIOR ART

The CH-PS No. 173 516 describes a gas blast switch of the aforementioned kind. In this known gas blast switch there is provided an open channel connecting the arcing enclosure through the storage enclosure with the quenching enclosure, which insures that the pressure built up by the auxiliary arc in the arcing enclosure propels fresh gas from the storage enclosure into the quenching enclosure in order to facilitate the quenching of the main arc in the quenching enclosure. However, during the switching movement a second channel becomes connected in parallel with this open channel, namely once the movable contact piece has left the passage provided in the separation wall between the arcing enclosure and the quenching enclosure. Now this direct communication between the arcing enclosure and the quenching enclosure entails first, a lowering of the pressure in the arcing enclosure, which weakens the movement of fresh gas from the storage enclosure into the quenching enclosure, and secondly, that ionized hot gas flows through the direct channel thus available into the quenching enclosure, whereby the quenching of the main arc is impeded. The quenching characteristics of this known switch depend on the ratio of the flow resistance between the arcing enclosure and the quenching enclosure, when taken through the storage enclosure on one hand, and through the aperture provided for the movable contact piece in the separation wall on the othr hand. Especially in a gas blast switch intended for carrying comparatively large rated currents and for the switching of comparatively high short circuit currents, one needs a relatively thick movable contact piece, which entails that in such a switch the aforementioned flow resistance through the storage enclosure is not much smaller than through the opening in the separation wall anymore. Therefore, the known gas blast switch taught by the CH-PS No. 173 516 cannot be constructed in a way which is suitable for comparatively large rated currents, and for switching of comparatively high short circuit currents.

The patent CH-PS No. 250 184 describes a further gas blast switch with an arcing or pressure enclosure and a quenching enclosure, which, however, does not exhibit a storage enclosure provided with at least one flow diverter. The arcing enclosure is directly connected with a quenching enclosure located opposite an expansion enclosure, and closed by a relief valve which is mounted on the resting contact piece. For a part of its length, the movable contact piece is made of an insulating material. In the switched-on position this insulating part is shorted by a conductive bushing which lies between the arcing enclosure and the quenching enclosure. It follows that in the switched-on position of the switch there exist three contact points which are responsible for heat losses, namely between the movable contact piece and the bushing, between the bushing and the part of the movable contact piece which is fixed to the insulating piece, and finally between this part of the movable contact piece and the resting contact piece. During the switching-off the insulating part of the movable contact piece is first pulled into the arcing enclosure, thus inducing therein an auxiliary arc. Then the part of the movable contact piece which is fixed to the insulating piece is pulled out of the resting contact piece, and thereafter begins the quenching of the arc, in connection with the flow of comparatively hot and ionized gas from the quenching enclosure through the relief valve and into the expansion enclosure. A drawback of this gas blast switch resides in the difficulty to find an adequate material for the insulating piece of the movable contact piece, i.e. a material which will stand the electrical, thermal and mechanical stresses involved. Furthermore the relief valve which closes the expansion enclosure is a very sensitive element, which is endangered when comparatively high short circuit currents are being switched-off; especially its threshold value will easily shift, and it is difficult to maintain it constant in use. Moreover this gas blast switch is not suited for achieving comparatively high rated currents and also not for interrupting comparatively high short circuit currents.

The Swiss patent CH-PS No. 385 319 describes a gas blast switch where there is provided a spring urged contact follower rod. During the switching-off this follower rod will first separate from the resting contact piece, thus provoking an ancillary arc. Thereafter the movable contact piece also separates from the follower rod in the quenching enclosure. The pressure built up in the quenching enclosure by both the ancillary arc and the main arc urges quenching gas through an outlet which is being freed by the movable contact piece during the switching-off movement. Nothing is said about the input of fresh gas into the quenching enclosure. This switch, too, is unsuited for interrupting comparatively high short circuit currents. It is also not suited for comparatively high values of the rated current flow, because the points of contact between the resting contact piece and the follower rod, and also between the latter and the resting contact piece simultaneously are burning locations of arcs, and as a result the electrical resistance of these contact locations may become too high in use, without that this is noticed. When carrying high currents, an unnoticed heating up of these places can happen, and exceed the allowed values.

SUMMARY OF THE INVENTION

The present invention aims at providing a gas blast switch of the aforementioned kind which is suited for carring comparatively high operating currents and also for switching-off comparatively high short circuit currents.

This aim is attained by a switch where the resting contact pieces cooperate with an insulating follower piston which it surrounds, and which is urged into its resting position during the switching-on movement by the action of the movable contact piece and against the force of a spring, and where during the switching-off movement the follower piston will follow the movable contact piece until it leaves the partitioning wall and will thereafter close the aperture of the same, which aperture lies between the arcing enclosure and the quenching enclosure, and where the border zones of the partitioning wall facing the arcing enclosure and the quenching enclosure, respectively, are electrically connected.

Such an arrangement insures that during the whole switching-off stroke gas may flow into the quenching enclosure only via the storage enclosure, which contains fresh gas. The insulating follower piston cuts off all direct communication between the arcing enclosure and the quenching enclosure. The electrical connection between the border zones of the separation wall aperture facing the arcing enclosure and the quenching enclosure, respectively, is provided in order to accommodate the current which flows through the arc.

Advantageously the insulating follower piston can be hollow. This insures a pressure compensation of the insulating piston, and one need not provide a spring to counteract the pressure in the quenching enclosure.

During the switching-off stroke, after the movable contact piece has separated from the insulating follower piston, the quenching enclosure can communicate through the passage in the hollow insulating follower piston with an additional expansion enclosure provided on the side of the insulating follower piston opposite that of the quenching enclosure. This arrangement permits the dividing or the enlarging of the expansion enclosure through the provision of one additional enclosure.

The border zone of the aperture in the separation wall can consist of a conductive ring inset into the aperture. This makes for an economically advantageous manufacturing process for the separation wall. Preferably the ring consists of graphite.

BRIEF DESCRIPTION OF THE DRAWING

A preferred embodiment of the invention will be described hereafter with reference to the drawing, the only FIGURE of which shows a schematical axial cut through a gas blast switch.

DETAILED DESCRIPTION OF A PREFERRED EMBODIMENT

The illustrated gas blast switch has a gastight housing 1 made of insulating material and filled with a quenching gas, for instance, sulfur hexaflouride. In the housing 1 there is a fixed contact piece 2, which exits through the upper front surface of the housing and is anchored therein. The fixed contact piece 2 has a crown of resilient contact fingers 4, in front of which there is provided a consumable electrode 5.

The space within the housing 1 is divided into an arcing enclosure 6, a storage enclosure 7, a quenching enclosure 8, and an expansion enclosure 9. The arcing enclosure 6 lies between the consumable electrode 5 and a separation wall 10 lying at a certain distance from the consumable electrode, in the switching-off direction. This storage enclosure 7 is limited by the resting contact piece 2, the housing 1, and the separation wall 10; it includes a cylindrical flow diverter 11, which is affixed to the separation wall 10 and free at its upper end, and coaxially surrounds the resting contact piece 2 at a certain distance. The storage enclosure 7 has open communications, first directly with the arcing enclosure 6, and secondly, with the quenching enclosure 8, through several openings 12 which are provided in the separation wall 10, radially behind the flow diverter 11. The quenching enclosure 8 is separated from the expansion enclosure 9 by an electrically insulating intermediate partition 13 which is fixed to the housing 1; further the quenching enclosure 8 is partitioned by an insulating disc 15 which has openings 14.

In the switched-on position (which is shown in the right-hand half of the FIGURE) a movable, tubular contact piece 16 extends through the passages provided in the insulating disc 15 and the intermediate partition 13, and also through the aperture 17 provided in the separation wall 10, and engages with its free end 18 into the crown of the contact fingers 4. The interior of the movable, tubular contact piece 16 is closed by a partition 19. Between this partition and the free end 18 of the movable contact piece 16 there are provided openings 20 in the wall of the tube in order to allow a flow communication between the quenching enclosure 8 and the expansion enclosure 9 during the switching-off stroke. The lower end of the movable contact piece 16 is held by a set of gliding contacts 21, themselves fixed to a ring 22 which itself is the end part of a connective conductor 23. This connector is fixed to the housing 1 at location 24, and exits laterally from the housing. The lower end of the movable contact piece 16 is connected through an insulating actuating rod 25 to an actuating mechanism schematically indicated by 26, and which can move the movable contact piece 16 vertically.

An axially movable insulating follower piston 27 is mounted within the resting contact piece 2. This piston can be made of polytetrafluorethylene, which is a polymer of trifluorchlorethylene, or of any other suitable electrically insulating material. During the switch-on stroke, this insulating follower piston will be pushed by the movable contact piece 16, and against the force of a spring 28, into its rest position. During the switch-off stroke the piston will be urged by the spring 28 and follow the movable contact piece 16 until it leaves the separation wall 10. During the following part of the switch-off stroke the insulating follower piston 27 remains stopped and closes the opening 17 in the separation wall 10, which opening lies between the arcing enclosure 6 and the quenching enclosure 8. In order to insure an electrical connection between the mouth portions of the opening 17 in the separation wall 10 facing the arcing enclosure 6 on one side and the quenching enclosure 8 on the other, an electrically conductive ring 29 made of graphite is inset into the separation wall 10. This ring limits the opening 17.

Within the resting contact piece 2 there is provided an additional expansion enclosure 30 which in the course of the switch-off stroke becomes flow connected with the quenching enclosure 8, through the hollow insulating follower piston 27.

If now the switch-off stroke begins, then the insulating follower piston 27 will be urged by the spring 28, and follow the movement of the movable contact piece 16. An ancillary arc 31 will ignite in the arcing enclosure 6 ony when the upper end 18 of the movable contact piece 16 has separated from the contact fingers 4 and the consumable electrode 5. This arc is the pressure providing arc, which builds up a pressure increase in the arcing enclosure. As the switch-off stroke proceeds, the upper end 18 of the movable contact piece 16 will leave the aperture 17 in the separation wall 10. The front part of the insulating follower piston 27 penetrates into this aperture, stops, and closes it. In the meantime the ancillary arc 31 burns on in the arcing enclosure 6, between the consumable electrode 5 and the ring 29. The pressure increase provoked by this ancillary arc 31 urges the quenching gas in the direction of the arrows 32. Fresh, cold gas is blown from the storage enclosure 7 through the openings 12 into the quenching enclosure 8, thus increasing the pressure therein, relative to the expansion enclosure. As soon as the upper end 18 of the movable contact piece 16 separates from the now immobile front part of the insulating follower piston 27, fresh gas from the quenching enclosure 8 can flow first into the additional expansion enclosure 30 and, as soon as the openings 20 have left the intermediate partition 13 in the course of the switch-off stroke, also into the expansion enclosure 9. This gas flow can then blow against the main arc 33 which burns between the ring 29 and the upper end 18 of the movable contact piece 16, and quench it.

What is claimed is:

1. Gas blast switch with a resting contact piece and a rodlike movable contact piece which can be axially engaged with the resting contact piece, and with a housing, the interior of which is divided into an arcing enclosure which extends between a consumable electrode situated in front of the resting contact piece and a separation wall fitted into the housing, remote from said consumable electrode in the switching-off direction and having an aperture for the passage of the movable contact piece, a quenching enclosure which extends between said separation wall and an intermediate partition fitted into the housing on the far side of said separation wall, again as seen in the switching-off direction, and an expansion enclosure, which lies on the side of the partition opposite to the quenching enclosure to which it becomes connected by a gas-path through a channel which is freed from the movable contact piece during the switching movement, where the arcing enclosure and the quenching enclosure are connected by way of a storage enclosure which has a larger capacity than the arcing enclosure and exhibits at least one flow-diverter, characterized in that the resting contact piece cooperates with an insulating follower piston which it surrounds, and which is urged into its resting position by the action of the movable contact piece and against the force of a spring during the switching-on movement, and where during the switching-off movement the follower piston will follow the movable contact piece until it leaves the partitioning wall, and will thereafter close the aperture of the same, which aperture lies between the arcing enclosure and the quenching enclosure, and where the border zones of the partitioning wall aperture facing the arcing enclosure and the quenching enclosure, respectively, are electrically connected.

2. Gas blast switch according to claim 1, characterized in that the insulating follower piston is hollow.

3. Gas blast switch according to claim 2, characterized in that, during the switching-off movement and after the separation of the movable contact piece from the insulating follower piston, the quenching enclosure is brought into communication, through the hollow insulating follower piston, with an additional expansion enclosure situated on the far side of the follower piston, relative to the quenching enclosure.

4. Gas blast switch according to claim 1, characterized in that the border region of the aperture in the separation wall consists of a conductive ring fitted into said wall.

5. Gas blast switch according to claim 4, characterized in that the ring is made of graphite.

* * * * *